US007635018B2

(12) United States Patent
Carmen, Jr. et al.

(10) Patent No.: US 7,635,018 B2
(45) Date of Patent: Dec. 22, 2009

(54) SYSTEM FOR CONTROLLING A ROLLER SHADE FABRIC TO A DESIRED LINEAR SPEED

(75) Inventors: Lawrence R. Carmen, Jr., Bath, PA (US); David J. Dolan, Center Valley, PA (US); Mark A. Walker, Whitehall, PA (US)

(73) Assignee: Lutron Electronics Co. Inc., Coopersburg, PA (US)

( * ) Notice: Subject to any disclaimer, the term of this patent is extended or adjusted under 35 U.S.C. 154(b) by 0 days.

(21) Appl. No.: 11/897,326

(22) Filed: Aug. 30, 2007

(65) Prior Publication Data

US 2007/0295460 A1 Dec. 27, 2007

Related U.S. Application Data

(63) Continuation of application No. 10/774,919, filed on Feb. 9, 2004, now Pat. No. 7,281,565.

(51) Int. Cl.
*A47G 5/02* (2006.01)

(52) U.S. Cl. ..... 160/310; 160/188; 318/268

(58) Field of Classification Search ..... 160/310, 160/296, 188, 170, 171, 84.02, 168.1 P, 120; 242/390.9, 421.2, 365.7, 413.2, 421.4, 420.5; 318/268

See application file for complete search history.

(56) References Cited

U.S. PATENT DOCUMENTS

| | | | | |
|---|---|---|---|---|
| 3,446,263 | A * | 5/1969 | Roth | 160/120 |
| 4,231,411 | A * | 11/1980 | Hehl et al. | 160/120 |
| 5,556,492 | A | 9/1996 | Vonderhorst | 156/64 |
| 5,848,634 | A | 12/1998 | Will et al. | 160/310 |
| 6,082,433 | A | 7/2000 | Vafaie et al. | 160/310 |
| 6,100,659 | A | 8/2000 | Will et al. | 318/466 |
| 6,201,364 | B1 | 3/2001 | Will et al. | 318/466 |
| 6,497,267 | B1 | 12/2002 | Azar et al. | 160/310 |
| 6,672,363 | B2 | 1/2004 | Schmidt | 160/310 |
| 6,831,431 | B1 | 12/2004 | Dieterle | 318/268 |
| 7,281,565 | B2 * | 10/2007 | Carmen et al. | 160/310 |
| 7,537,040 | B2 * | 5/2009 | Carmen et al. | 160/120 |
| 2001/0045489 | A1 | 11/2001 | Eugster et al. | 242/528 |
| 2004/0174126 | A1 | 9/2004 | Chapman et al. | 318/268 |
| 2004/0250964 | A1 * | 12/2004 | Carmen et al. | 160/120 |

(Continued)

FOREIGN PATENT DOCUMENTS

| | | |
|---|---|---|
| JP | 05086783 | 4/1993 |

*Primary Examiner*—Blair M. Johnson
(74) *Attorney, Agent, or Firm*—Drinker, Biddle & Reath LLP

(57) ABSTRACT

A system for controlling a roller shade having a roller tube windingly receiving a shade fabric varies roller tube rotational speed for constant linear shade speed. The desired linear shade speed, roller tube diameter and shade fabric thickness and length are stored in a memory for use by a microprocessor. Preferably, the roller tube rotational speed is varied by the microprocessor depending on shade position determined by signals from Hall effect sensors. The microprocessor maintains a counter number that is increased or decreased depending on direction of rotation. Based on the counter number, the microprocessor determines shade position and a corrected rotational speed for the desired linear shade speed. Preferably, the microprocessor controls roller tube rotational speed using a pulse width modulated signal. The system may be used to control first and second roller shades having roller tubes of differing diameters or shade fabrics of varying thicknesses.

20 Claims, 7 Drawing Sheets

U.S. PATENT DOCUMENTS

2006/0232233 A1 10/2006 Adams et al. ..... 318/280
2006/0232234 A1 10/2006 Newman ..... 318/280
2007/0272374 A1* 11/2007 Moseley et al. ..... 160/310

* cited by examiner

SYSTEM FOR CONTROLLING A ROLLER SHADE FABRIC TO A DESIRED LINEAR SPEED

CROSS-REFERENCE TO RELATED APPLICATION

This application is a continuation of U.S. patent application Ser. No. 10/774,919, filed Feb. 9, 2004, now U.S. Pat. No. 7,281,565, which is hereby incorporated by reference in its entirety.

FIELD OF THE INVENTION

The invention relates to a system for controlling shade fabric speed for multiple motorized roller shades.

BACKGROUND OF THE INVENTION

Motorized roller shades include a flexible shade fabric wound onto an elongated roller tube. The roller tube is rotatably supported so that a lower end of the shade fabric can be raised and lowered by rotating the roller tube. The roller tubes are generally in the shape of a right circular cylinder having various lengths for supporting shade fabrics of various width. Motorized roller shades include a drive system engaging the roller tube to provide for tube rotation.

For aesthetic reasons, it is desirable that the outer diameter of the roller tube be as small as possible. Roller tubes, however, are generally supported only at their ends and are otherwise unsupported throughout their length. Roller tubes, therefore, are susceptible to sagging if the cross-section of the roller tube does not provide for sufficient bending stiffness for a selected material. Therefore, increase in the length of a roller tube is generally accompanied by increase in the outer diameter of the tube.

In certain situations, such as for shading areas of very large width or for shading areas that are non-planar across their width, it may be desirable to use multiple roller shades. In these situations, it may also be necessary or desirable to use roller tubes having different lengths. Relatively long tubes might require that a larger diameter be used compared to shorter tubes in order to limit sagging.

Where multiple roller shades are used to shade a given area, the capability of raising or lowering the shades such that their lower ends move consonantly as a unit (i.e., simultaneously at the same speed) is desirable. However, two roller shades having tubes of differing diameter will not raise or lower a shade fabric at the same speed if they are rotated at the same rotational speed.

For any member that is rotated about a central axis, the linear speed at a surface of the rotating member will depend on the distance between the surface and the rotational axis. Thus, for a given rotational speed (i.e., rpm), the resulting linear speed (i.e., in/sec) at the outer surface of the tube will vary in direct proportion to outer tube diameter. Therefore, two roller tubes having differing outer diameters that are driven at the same rotational speed will have different linear speeds at the outer surface. The larger diameter tube will have a higher linear speed at the outer surface and, accordingly, will windingly receive, or release, the associated shade fabric at a faster rate than the smaller diameter tube.

The ability to provide consonant shade speed for two roller shades having tubes of differing diameters is further complicated because the shade speed for either one of the roller shades will not remain constant as the shade is raised or lowered between two shade positions. The winding receipt of a shade fabric onto a roller tube creates layers of overlapping material that increases the distance between the rotational axis and the point at which the shade fabric is windingly received compared to the distance at the tube outer surface. As a result, the shade speed will vary depending on the thickness of the overlapping layers of material received on the roller tube.

SUMMARY OF THE INVENTION

According to one aspect of the invention, a method for controlling a roller shade is provided. The roller shade includes a rotatably supported roller tube windingly receiving a flexible shade fabric. The method comprises the step of rotating the roller tube to move a lower end of the shade fabric with respect to the roller tube between first and second shade positions. The method further includes the step of varying the rotational speed at which the roller tube is rotated during the movement of the shade fabric such that the speed at which the lower end of the shade is moved remains substantially constant.

According to one embodiment, the roller shade for the method includes a motorized drive system and the speed at which the roller tube is rotated is varied depending on the position of the roller shade. A Hall effect sensor assembly and microprocessor are provided. The microprocessor maintains a counter number that is increased or decreased in response to signals from the Hall effect sensor assembly depending on direction of rotation of a motor output shaft. The method further includes the step of assigning a default counter number associated with a default shade position and determining the difference between the counter number at a given shade position and the default counter number. Based on the difference in counter number, the number of equivalent revolutions of the roller tube and the shade position are determined.

According to one embodiment, the shade fabric associated with the method has a thickness and is movable between a fully-opened shade position and a fully-closed shade position. The method includes the step of selecting a desired linear speed for the shade fabric and determining a base rotational speed for moving the shade fabric at the desired linear speed at the fully-closed shade position. Next the number of revolutions needed to move the shade fabric between the fully-closed and fully-opened shade positions based on the length and thickness of the shade fabric is determined. A fully-wound radius, which is equal to the distance between a rotational axis for the roller tube and the point at which the shade fabric is windingly received at the fully-opened shade position, is then determined. Based on the fully-wound radius, a rotational speed reduction with respect to the base rotational speed necessary to move the shade fabric at the desired linear speed at the fully-opened shade position is then determined. Preferably, the rotational speed reduction necessary at other shade positions is then determined by scaling the fully-opened rotational speed reduction.

According to another aspect of the invention, a roller shade system comprises first and second roller shades each including a rotatably supported roller tube and a flexible shade fabric windingly received by the roller tube. Each of the roller shades further includes a drive system operably engaging the associated roller tube for drivingly rotating the roller tube to move a lower end of the associated shade fabric between a fully-opened shade position and a fully-closed shade position. Each of the drive systems is adapted to vary the rotational speed at which the associated roller tube is rotated. The second roller tube has a diameter that is larger than the diameter of the first tube. The system further includes at least one controller for controlling the first and second roller shades, the controller adapted to rotate the first roller tube at a rotational speed that is less than that for the second roller tube such that the lower ends of the first and second shade fabrics move together at substantially the same linear shade speed.

According to one embodiment, each drive system includes a motor having a rotatingly driven output shaft. The at least one controller is adapted to direct a pulse width modulated duty cycle signal to the drive systems of the roller shades to vary the rotational speed of the motor output shafts.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown. In the drawings.

DETAILED DESCRIPTION OF THE DRAWINGS

Figure 1:
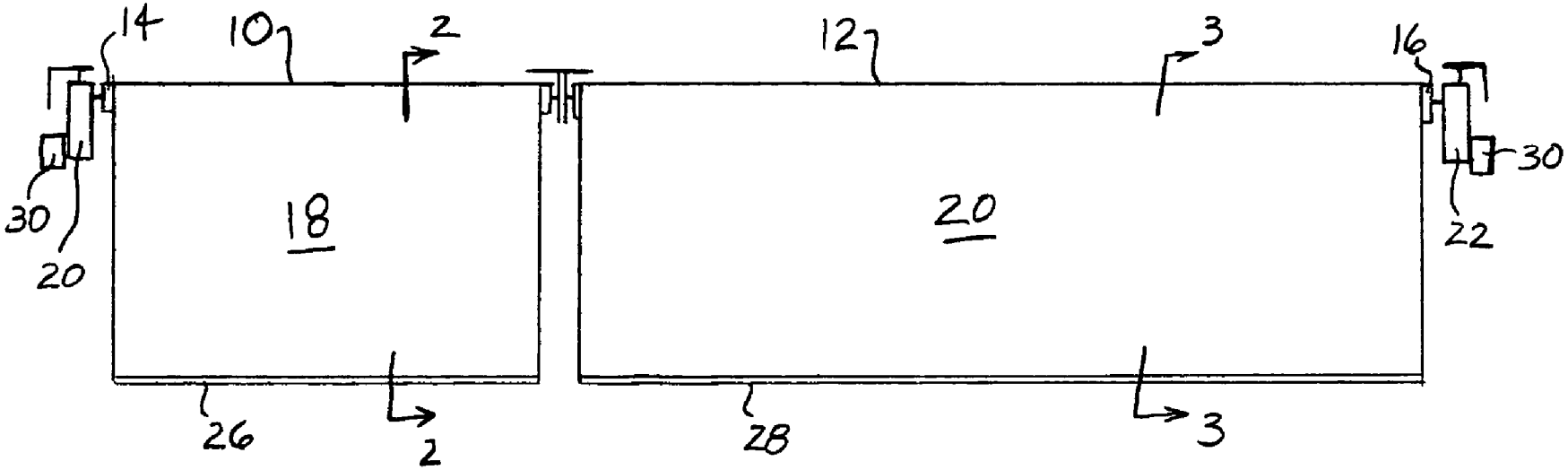
FIG. 1 is a front elevational view of two roller shades incorporating a shade speed control system according to the present invention.

Referring to the drawings, where like numerals identify like elements, there is illustrated in FIG. 1 a pair of roller shades 10, 12 respectively including elongated roller tubes 14, 16 that are rotatably supported. The roller tubes 14, 16 support flexible shade fabrics 18, 20 that are windingly received onto, or released from, an outer surface of the roller tubes 14, 16 depending on the direction in which the roller tubes 14, 16 are rotated. The roller shades 10, 12 are arranged in side-by-side fashion to provide combined coverage of a shading area. In known manner, each of the roller tubes 14, 16 is rotatably supported to a fixed support such as a wall or ceiling, for example. The roller tubes 14, 16, however, are not supported along their lengths between the end supports. Roller tubes having large aspect ratios (i.e., length versus outer diameter) are susceptible to sagging deflections under the combined weight of the tube and a shade fabric. The use of multiple roller shades, therefore, is desirable for shading relatively wide shading areas, because the diameter of each tube can made relatively small, in comparison with that required for a single tube spanning the width, without excessive sagging.

As shown, the roller tube 16 is approximately twice as long as roller tube 14. The aspect ratio for each of the tubes 14, 16, however, has been optimized to provide the smallest diameter tube that will not sag excessively when supported at its ends and supporting the associated shade fabric 18, 20. Accordingly, the outer diameter of roller tube 16 is larger than that of roller tube 14, as shown by comparing FIGS. 2 and 3. In the past, this issue of varying length for multiple tubes was addressed by both tubes having the larger diameter required by the longer tube. As a result, the shorter of the two tubes would inefficiently have a larger aspect ratio than necessary.

The roller shades 10, 12 include motors 22, 24 engaging the associated roller tubes 14, 16 for separately driving the tubes. The present invention provides a control system for driving the shade fabrics 18, 20 between two shade positions (e.g., between fully-opened and fully-closed positions) in uniform fashion such that the lower ends 26, 28 of the shade fabrics 18, 20 move together at substantially the same speed. The movement of the lower ends 26, 28 of the shade fabrics 18, 20 is sometimes hereinafter referred to as "shade speed." This manner of driving the shade fabrics 18, 20 provides a consonant appearance to the lower ends 26, 28 of shade fabrics 18, 20 simulating a single, unitary shade fabric extending across the width of the shading area. As described below, in greater detail, the differing outer diameters of the two roller tubes 14, 16 results in differing shade-winding characteristics for the tubes 14, 16, thereby complicating the desired control for uniform shade movement.

Because the outer surface of tube 16 is located at a greater distance from the rotational axis, compared to that for roller tube 14, the linear speed at the outer surface of tube 16 will be greater than that for roller tube 14, if the roller tubes 14, 16 are driven at the same rotational speed. As a result, roller tube 16 will windingly receive, or release, the shade fabric at a faster rate than roller tube 14, if the roller tubes 14, 16 are driven at the same rotational speed. Therefore, in order to provide for uniform driving of the shade fabrics 18, 20, at the same linear speed, roller tube 16 will need to be driven at a slower rotational speed than tube 14.

Figure 3:
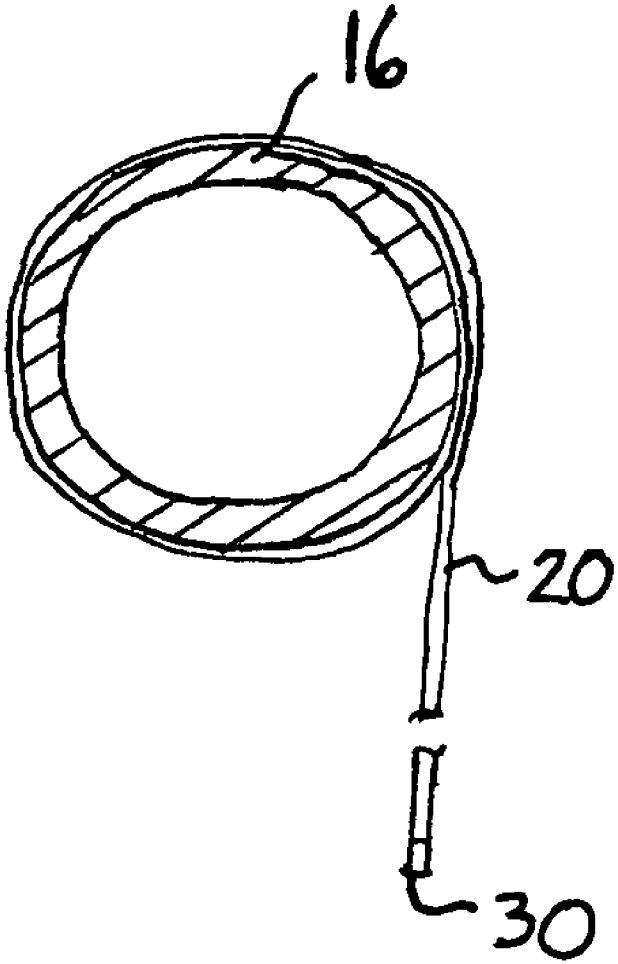
FIG. 3 is a sectional view of the other one of the roller shades of FIG. 1 taken along the line 3-3.
Figure 2:
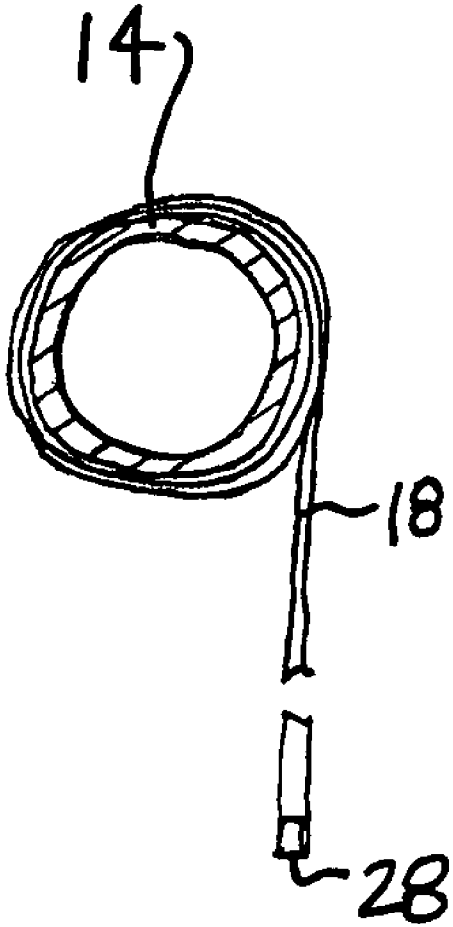
FIG. 2 is a sectional view of one of the roller shades of FIG. 1 taken along the line 2-2.

Controlling the roller shades 10, 12 for uniform shade speed is further complicated, however, because the winding of each shade fabric 18, 20 onto the outer surface of the associated roller tube 14, 16 results in variation in shade speed as the shade fabrics 18, 20 are moved between two shade positions, even if each of the roller tubes 14, 16 is driven at a constant rotational speed. As shown in FIGS. 2 and 3, the winding receipt of the shade fabrics 18, 20 by the roller tubes 14, 16 creates overlapping layers of material, thereby varying the distance between the rotational axis and the point at which the shade fabric 18, 20 is being windingly received by the associated roller tube 14, 16. As a result, shade speed will progressively increase as shade fabrics 18, 20 are being raised, or progressively decrease as the shade fabrics 18, 20 are being lowered, even if each of tubes 14, 16 is driven at a constant rotational speed.

The rate at which shade speed will vary will not be the same for the roller shades 10, 12 because a given length of material will form more winding layers on the smaller diameter roller tube 14 than the same length of material will form on the larger diameter roller tube 16. As a result, a given amount of movement for the shade fabrics 18, 20 will have a greater impact on the shade speed for roller shade 10 than for roller shade 12.

Figure 4:
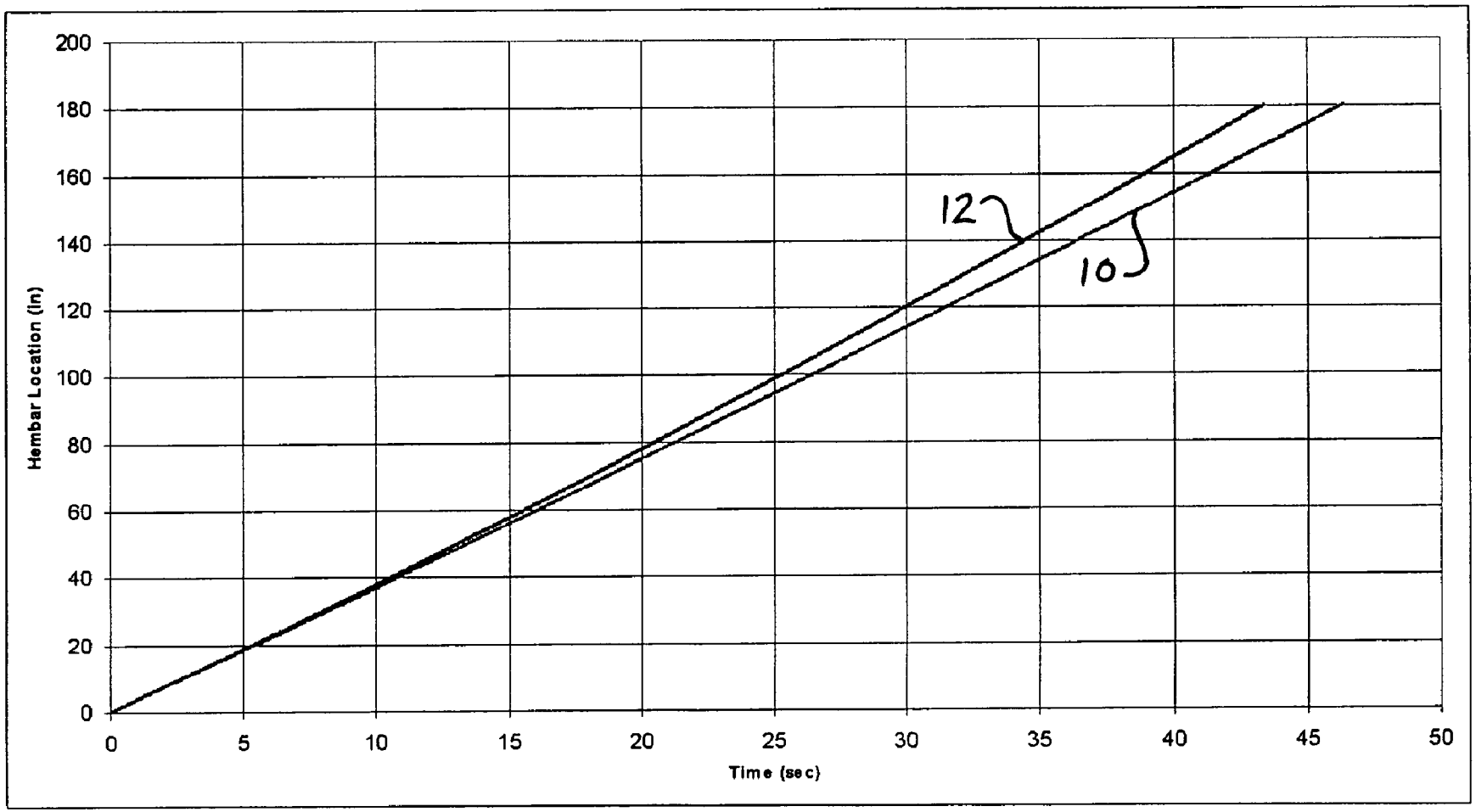
FIG. 4 is a graphical illustration showing shade speed for two roller shades having roller tubes of differing outer diameter driven at a constant rotational speed.
Figure 5:
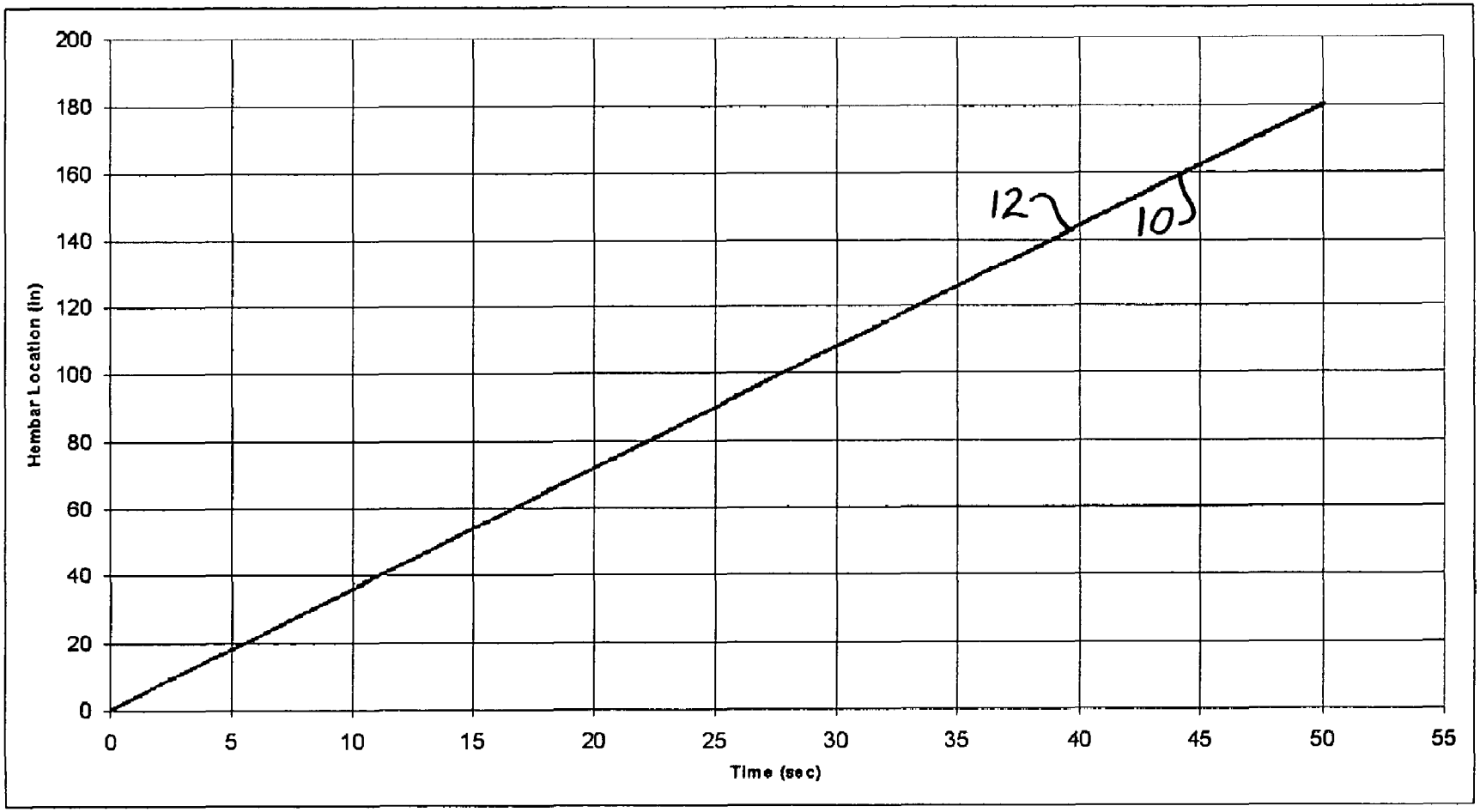
FIG. 5 is a graphical illustration showing identical linear shade speed for the two roller shades of FIG. 4 using the shade speed control system of the present invention.

Referring to the graphical illustrations of FIGS. 4 and 5, the present invention provides a system for controlling the motors 22, 24 of roller shades 10, 12 that accounts for the above-described effects of tube diameter and fabric thickness to drive the shade fabrics 18, 20 together between two shade positions at a substantially constant shade speed. FIGS. 4 and 5 illustrate hem bar location versus time. As well known in the art, hem bars are located at the lower ends of shade fabrics to weight the shade fabrics, thereby facilitating winding of the shade fabrics. FIGS. 4 and 5, therefore, illustrate movement of the lower ends of shade fabrics 18, 20 of the roller shades 10, 12 versus time.

FIG. 4 illustrates the relationship between the movement of the lower end of the shade fabrics 18, 20 that would result if the roller tubes 14, 16 of roller shades 10, 12 were driven at a constant rotational speed. As shown, the hem bar for roller shade 12 is moved at a faster rate than the hem bar for roller shade 10. The above-described effects that the fabric winding has on shade speed is also illustrated. If shade speed were constant for roller shades 10, 12, the resulting relationship for either roller tube 14, 16 should appear as a straight line. However, because the point of winding receipt is moved outwardly from the rotational axis due to the fabric-winding effect, the relationship is not linear. Instead, the curves turn upwardly for each of the roller shades 10, 12 to illustrate that shade speed for each increases over time.

FIG. 5 illustrates the shade speed that results when the roller shades 10, 12 are operated using a shade speed control system 30 according to the present invention. As described below, the control system 30 varies the rotational speed at which the roller tubes 14, 16 of roller shades 10, 12 are driven as the associated shade fabrics 18, 20 are moved between two shade positions. As shown, the resulting shade speeds for the roller shades 10, 12 are substantially identical. Also, as shown, the shade speeds for roller shades 10, 12 are substantially linear.

Figure 6:
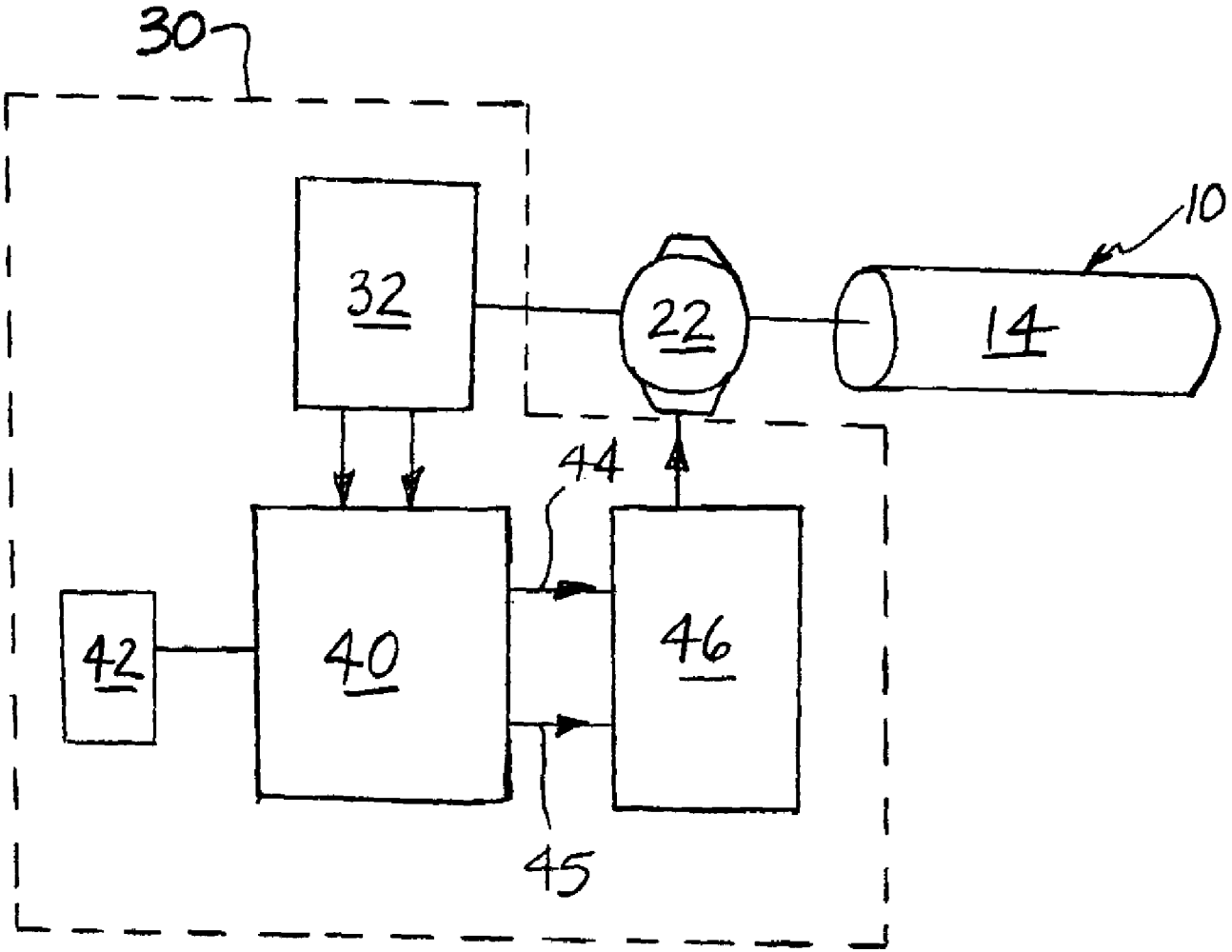
FIG. 6 is a schematic illustration illustrating a shade speed control system according to the present invention.

Referring to FIG. 6, the roller shade control system 30 according to the present invention is illustrated schematically. The following description for control system 30 refers only to roller shade 10, it being understood that a similar control system would be used to control roller shade 12.

Figure 7:
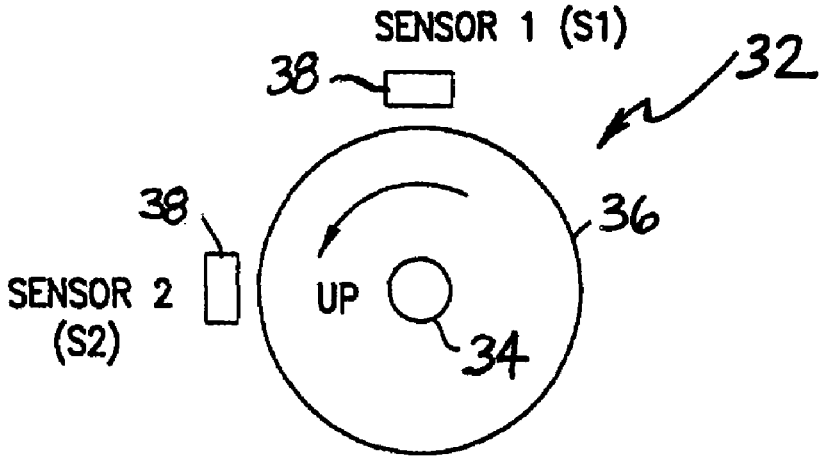
FIG. 7 is a partial end view showing the Hall effect sensor assembly of the shade speed control system of FIG. 4.
Figure 8:
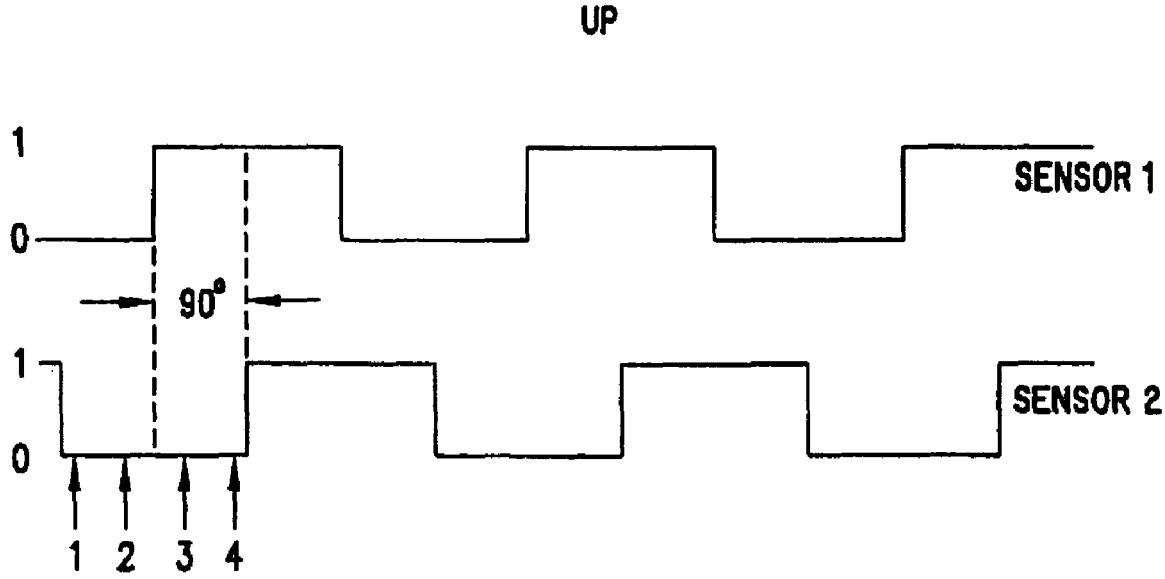
FIG. 8 is a schematic illustration of pulse trains generated by the sensors of the Hall effect sensor assembly of FIG. 7

The control system 30 includes a Hall effect sensor assembly 32 connected to the motor 22 to provide information regarding rotational speed and direction for the motor's output shaft 34. As shown in FIG. 7, the Hall effect sensor assembly 32 includes a sensor magnet 36 secured to the output shaft 34 of the motor 22 and Hall effect sensors 38 identified as sensor 1 (S1) and sensor 2 (S2). The sensors 38 are located adjacent the periphery of magnet 36 and separated by 90 degrees. The sensors 38 provide output signals in the form of pulse trains. The frequency of the pulses is a function of the rotational speed of the motor output shaft 34. The relative spacing between the two pulse trains is a function of rotational direction. When the associated shade fabric 18 is driven in an upwards direction corresponding to the motor direction shown in FIG. 7, the pulse trains from sensors 1 and 2 are in the relative positions shown in FIG. 8, with sensor 1 leading sensor 2 and 90 degrees out of phase.

Referring again to FIG. 6, the control system 30 includes a microprocessor 40 operably connected to the Hall effect sensor assembly 32 to receive the pulse train signals generated by the rotating output shaft 34. As described below in greater detail, the microprocessor 40 uses the information regarding the rotation of the motor shaft 34 to track the position of the shade fabric 18 as it is moved between two shade positions. The microprocessor 40 is coupled to a memory 42.

The microprocessor directs motor control signals 44, 45 to the motor 22, preferably through an H-bridge circuit 46. Control signal 44 directs the motor to brake or to rotate the roller tube 14 in one of opposite directions. Control signal 45 is a 20 kHz pulse width modulated signal that controls the duty cycle of the motor 22 for variation in motor rotational speed. Variation in motor rotational speed using a pulse width modulated duty cycle signal is shown and described in U.S. Pat. No. 5,848,634. As described, the microprocessor of the '634 patent directs a 2 KHz duty cycle signal to a PWM circuit. The PWM circuit reads the duty cycle signal from the microprocessor as an average DC level and uses it to set the pulse width of a pulse width modulated 20 KHz signal directed to the motor. In the present invention, a pulse width modulating circuit between the microprocessor and the motor is not used. Instead, the microprocessor 40 generates the PWM signal directly. Pulse width modulation for variable motor speed is presently preferred. The present invention, however, is not limited to variable motor speed by pulse width modulation.

Figure 9:
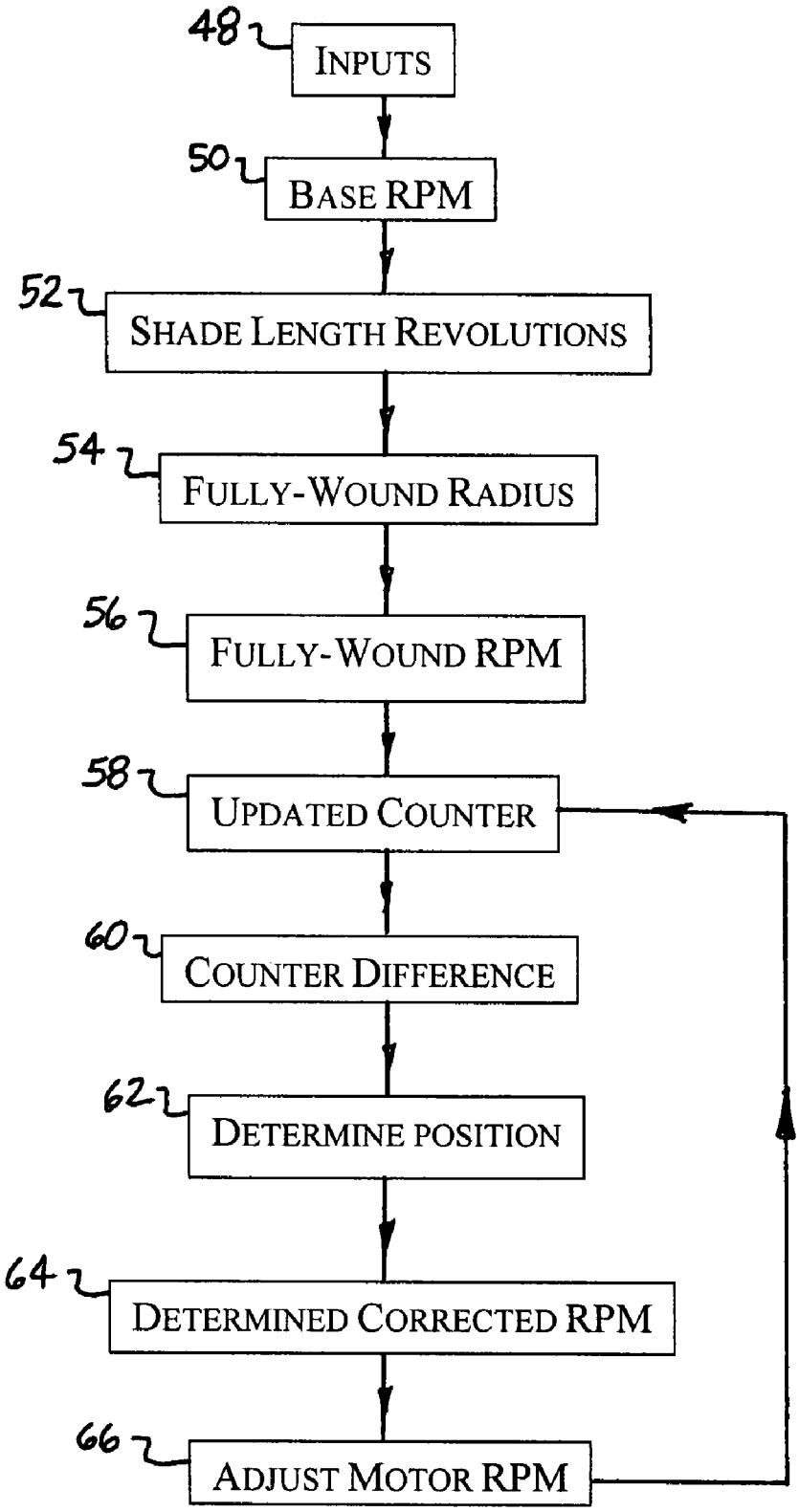
FIG. 9 is a flow diagram illustrating a method of controlling shade speed for a roller shade according to the present invention.

Referring to FIG. 9, a method of controlling shade speed for each of roller shades 10, 12 is illustrated schematically. For simplicity, only roller shade 10 will be included in the following description, it being understood that controlling shade speed for roller shade 12 would be accomplished in the same manner. As described above, linear speed at a point of a rotating member depends on the distance between the point and the rotational axis for the member. For a roller tube, linear speed at the tube outer surface is related to rotational speed according to the equation:

$$\text{Linear speed} = \text{rotational speed} \times \text{outer tube radius}$$

In a first step 48, values representing the size of roller tube 14 (i.e., outer diameter), the thickness of the associated shade fabric 18, the length of the shade fabric 18 (i.e., the length of material to be wound onto the roller tube 14 between the fully-closed position and the fully-opened position) and the desired linear speed for the shade fabric 18 are input. This information may be placed in storage on memory 42 and, therefore, this step need only be done once as part of an installation process. A hand-held programmer or a computer running a graphical-user interface program could be connected to the system 30 to facilitate input of the information.

Based on the above equation, and the input values for the size of roller tube 14 and the desired linear speed, the microprocessor 40 in step 50 determines the rotational speed necessary for the roller tube 14 to windingly receive the shade fabric 18 at the fully-closed shade position (i.e., at a distance from the rotational axis equal to the tube outer surface). This rotational speed associated with initial receipt of the shade fabric 18 by the roller tube 14 is hereinafter sometimes referred to as the "base RPM" or the "base rotational speed".

In step 52, the microprocessor 40 calculates the number of revolutions of the roller tube 14 necessary to wind the length of the shade fabric 18 onto the roller tube 14. As described above, the distance between the rotational axis and the point at which the shade fabric 18 is being windingly received onto the roller tube 14 will increase from the fully-closed position because of the overlapping layers of material. In step 54, the microprocessor 40 calculates the increase in this distance, hereinafter sometimes referred to as the "fully-wound radius", based on the input value for the thickness of the shade fabric 18 and the number of revolutions calculated in step 52.

Using the above equation relating rotational speed to linear speed, the microprocessor 40, in step 56, calculates the reduced rotational speed that will drive the shade fabric 18 at the desired linear speed for the larger fully-opened radius (hereinafter, the "fully-wound RPM"). Thus, the total amount by which the rotational speed will need to be reduced by the control system 30 during the winding of the shade fabric 18 to maintain a constant linear speed is equal to the difference between the base RPM and the fully-wound RPM.

The distance between the rotational axis and the point of winding receipt of the shade fabric 18 will vary depending on shade position. This distance will be equal to the tube outer radius when the shade fabric 18 is located at the fully-closed position and will be equal to the fully-wound radius at the fully-opened position. According to the method of FIG. 9, the microprocessor 40 in step 58 tracks the position of the shade fabric 18 by adding or subtracting revolutions of the motor output shaft 34, or a proportional number of Hall effect edge signals, to a counter number maintained by the microprocessor 40 depending on the direction of rotation. The microprocessor 40 in step 60 determines the difference between the current counter number and a default counter number that is associated with the fully-closed position. This counter number difference is then divided in step 62 by the number of tube revolutions, or the proportional number of Hall effect edge signals, necessary to wind the entire length of the shade fabric 18. The resulting percentage is then multiplied by the length of the shade to determine shade position (i.e., the linear distance between the fully-closed position and the current position).

Based on the current shade position determined in step 62, the microprocessor 40 in step 64 determines the corrected RPM by scaling the fully-wound correction, which is equal to the difference between the base RPM and the fully-wound RPM. For example, if the current shade position is three-quarters closed, the corrected RPM would be determined by subtracting 25 percent of the fully-wound correction from the base RPM.

The microprocessor 40 in step 66 then directs the PWM circuit 44 to set the rotational speed for the associated motor 22 to the corrected rotational speed determined by the microprocessor 40 in step 64. The above-described steps are repeated in cyclic fashion during the movement of the associated shade fabric 18 with the microprocessor 40 periodically updating current shade position and recalculating the corrected rotational speed based on the current shade position.

Referring again to FIG. 1, the motor 22 for roller shade 10 is located on the left-hand side of roller tube 14 and the motor 24 for roller shade 12 is located on the right-hand side of roller tube 16. Locating the motors 22, 24 oppositely from each other in this manner desirably limits the gap separating the shade fabrics 18, 20. Furthermore, it is desirable for both of the shade fabrics 18, 20 to be wound from the same side of the roller tubes 14, 16 (i.e., on the forward sides of the roller tubes 14, 16 opposite from the shading area). For this to happen, however, the motors 22, 24 must be driven in opposite rotational directions. As described above, the microprocessor 40 is programmed to maintain a counter by adding or subtracting shaft revolutions, or proportional number of Hall effect edge signals, depending on the direction in which the motor shaft is rotating. Because the desired simultaneous movement of the two shades requires opposite motor rotation, the lowering of the shade fabrics 18, 20 from the fully-opened position will result in increase to the counter number for one of the roller shades 10, 12 and a corresponding decrease in the other. It is desirable, therefore, that the default counter number that is associated with the fully-opened position be sufficiently large such that the resulting counter number at the fully-closed position is positive for both roller shades 10, 12.

In the above-described method, the rotational speed for the motors 22, 24 is corrected by tracking shade position in a cyclic fashion during movement of the associated shade fabrics 18, 20 and periodically determining a corrected motor speed for the motors 22, 24. The present invention is not limited to motor speed control using this procedure. It is within the scope of the invention to control speed using other procedures. For example, the microprocessor of the roller shade could be programmed to control motor speed based on the amount of time that it would take to move the shade between two shade positions at the input linear speed. As described above, the corrected motor speed will be increasing or decreasing depending on whether the shade is being opened or closed. Using a timing procedure, instead of the above-described position tracking method, the microprocessor would determine the total amount of motor speed correction to be applied by scaling from the fully-wound correction. For example, shade movement between the fully-closed position and the three-quarters closed position would require that the motor speed be reduced by 25 percent of the fully-wound correction. The microprocessor would direct the PWM circuit to reduce motor speed by the required amount in an even manner during the amount of time that the shade is moving.

The shade speed control system of the present invention was described above in relation to winding problems for multiple shades created when the tubes have differing outer diameters. Those skilled in the art will recognize that similar winding problems would be presented when multiple roller shades support shade fabrics having differing thicknesses. This will be true even if the outer diameter of the roller tubes are identical because distance between the rotational axis and the point of winding receipt will increase more rapidly for the roller shade supporting the thicker shade fabric.

In the above-described embodiments of the invention, the rotational speed of the roller tube was varied to provide for substantially constant speed for the associated shade fabric. The present invention, however, is not limited to constant shade speed. It is within the scope of the present invention, for example, to vary rotational speed for the roller tube to provide for a non-constant shade speed in which the shade varies in accordance with a desired relationship.

The foregoing describes the invention in terms of embodiments foreseen by the inventors for which an enabling description was available, notwithstanding that insubstantial modifications of the invention, not presently foreseen, may nonetheless represent equivalents thereto.

What is claimed is:

1. A method for controlling a roller shade having a rotatably supported roller tube windingly receiving a flexible shade fabric, the method comprising:

storing in a memory information representative of a desired linear speed of a lower end of the shade fabric;

providing a motor having a rotatably driven output shaft operably connected to the roller tube for rotating the roller tube;

rotating the roller tube to move the lower end of the shade fabric;

receiving a control signal representative of a rotational position of the roller tube;

determining a number of rotations of the roller tube required to move the lower end of the shade fabric between a default position and a current position in response to the control signal; and controlling a rotational speed of the motor as a function of the desired linear speed and the number of rotations required to move the lower end of the shade fabric between the default position and the current position, so as to control a linear speed of the lower end of the shade fabric to the desired linear speed.

2. The method of claim 1, further comprising the steps of:

incrementing a counter in response to the control signal when the output shaft of the motor is rotating in a first direction; and decrementing the counter in response to the control signal when the output shaft of the motor is rotating in a second direction.

3. The method of claim 2, wherein the step of determining a number of rotations of the roller tube required to move the lower end of the shade fabric between a default position and a current position further comprises determining the number of rotations required to move the lower end of the shade fabric between the default position and the current position in response to the value of the counter.

4. The method of claim 3, further comprising the step of:

determining an amount of fabric wound around the roller tube in response to the number of rotations required to move the lower end of the shade fabric between the default position and the current position.

5. The method of claim 4, further comprising the step of:

calculating a desired rotational speed of the output shaft by dividing the desired linear speed by a radius of the roller tube plus the amount of fabric wound around the roller tube.

6. The method of claim 2, wherein the control signal comprises a Hall-effect sensor signal from a Hall-effect sensor circuit.

7. The method of claim 6, wherein the step of incrementing further comprises incrementing the counter in response to a transition of the Hall-effect sensor signal when the output shaft of the motor is rotating in the first direction, and the step of decrementing further comprises decrementing the counter in response to a transition of the Hall-effect sensor signal when the output shaft of the motor is rotating in the second direction.

8. The method of claim 2, further comprising the step of:

determining a desired rotational speed of the output shaft in response to the desired linear speed, a radius of the roller tube, and the value of the counter.

9. The method of claim 1, further comprising the steps of:

determining that the roller tube has completed a revolution in response to the control signal; and changing a rotational speed of the output shaft of the motor in response to the step of determining that the roller tube has completed a revolution.

10. The method of claim 1, further comprising the step of:

determining the number of revolutions made by the roller tube when rotated between a fully closed position and a fully open position in response to the control signal.

11. The method of claim 1, further comprising the step of:

determining a desired rotational speed of the output shaft in response to the desired linear speed and a radius of the roller tube and an amount of fabric wound around the roller tube.

12. The method of claim 11, further comprising the step of:

calculating the desired rotational speed of the output shaft by dividing the desired linear speed by the radius of the roller tube and the amount of fabric wound around the roller tube.

13. The method of claim 11, further comprising the step of:

determining the amount of fabric wound around the roller tube in response to the number of rotations required to move the lower end of the shade fabric between the default position and the current position.

14. The method of claim 1, wherein the step of controlling the motor further comprises controlling the motor to vary the rotational speed of the output shaft in response to the number of rotations required to move the lower end of the shade fabric between the default position and the current position.

15. The method of claim 14, further comprising the step of:

determining a radius of the roller tube and an amount of fabric wound around the roller tube in response to the number of rotations required to move the lower end of the shade fabric between the default position and the current position;

wherein the step of controlling the motor further comprises determining a desired rotational speed of the output shaft in response to the desired linear speed and the radius of the roller tube and the amount of fabric wound around the roller tube.

16. The method of claim 1, wherein the step of controlling the motor further comprises controlling the motor to vary the rotational speed of the output shaft differently during consecutive revolutions of the roller tube, so as to control the linear speed of the lower end of the shade fabric to the desired linear speed.

17. The method of claim 1, further comprising the steps of:

determining when the roller tube has completed a revolution in response to the control signal; and adjusting the rotational speed of the output shaft of the motor when the roller tube has completed the revolution.

18. The method of claim 1, further comprising the steps of:

driving the motor with a pulse-width modulated signal to rotate the output shaft of the motor; and varying the duty cycle of the pulse-width modulated signal to control the rotational speed of the roller tube.

19. A method for controlling a roller shade having a rotatably supported roller tube, the roller tube windingly receiving a flexible shade fabric, the method comprising:

providing a motor operably engaging the roller tube to rotate the roller tube;

providing a control system including a memory, and adapted to vary the rotational speed at which the roller tube is rotated;

storing in the memory information representative of a desired linear speed of a lower end of the shade fabric;

the control system controlling the motor to rotate the roller shade to move said lower end of the shade fabric with respect to the roller tube between a fully closed position and a fully opened position;

the control system determining the present position of the lower end of the shade fabric;

the control system determining a number of revolutions of the roller tube between the present position and a fully closed position; and the control system controlling the motor to vary the rotational speed at which the roller tube is rotated as a function of the desired linear speed and the number of revolutions of the roller tube between the present position and the fully closed position, so as to control the linear speed of the lower end of the shade fabric to the desired linear speed.

20. A roller shade system for controlling a roller shade comprising:

a rotatably supported roller tube, the roller tube windingly receiving a flexible shade fabric;

a motor operably engaging the roller tube to rotate the roller tube;

a control system adapted to vary the rotational speed of the motor to rotate the roller tube to move a lower end of the shade fabric with respect to the roller tube, the control system further adapted to determine a present position of the lower end of the shade fabric, the control system further operable to determine a number of revolutions of the roller tube between the present position and a fully closed position; and a memory for storing information representative of a desired linear speed of the lower end of the shade fabric;

wherein the control system controls the motor to vary the rotational speed at which the roller tube is rotated as a function of the desired linear speed and the number of revolutions of the roller tube between the present position and the fully closed position, so as to control the linear speed of the lower end of the shade fabric to the desired linear speed.

* * * * *